US005204014A

United States Patent [19]

Redd et al.

[11] Patent Number: 5,204,014

[45] Date of Patent: Apr. 20, 1993

[54] LOW PH MILD PERSONAL CLEANSING BAR WITH LATHERING MILD SYNTHETIC SURFACTANT AND MAGNESIUM SOAP

[75] Inventors: Bruce L. Redd; Eddie C. Walker, both of Cincinnati; Robert E. Hare, Winchester; Donald A. Niederbaumer, Cincinnati; James C. Dunbar, Cincinnati; Theresa A. Bakken, Cincinnati, all of Ohio

[73] Assignee: The Proctor & Gamble Company, Cincinnati, Ohio

[21] Appl. No.: 887,570

[22] Filed: May 18, 1992

Related U.S. Application Data

[63] Continuation of Ser. No. 668,578, Mar. 13, 1991, abandoned.

[51] Int. Cl.[5] ..... C11D 9/18; C11D 9/48; C11D 10/04; C11D 13/18

[52] U.S. Cl. ..... 252/117; 252/108; 252/121; 252/132; 252/133; 252/134; 252/174; 252/368; 252/369; 252/370; 252/DIG. 5; 252/DIG. 16

[58] Field of Search ..... 252/108, 117, 121, 132, 252/133, 134, 174, 368, 369, 370, DIG. 5, DIG. 16

[56] References Cited

U.S. PATENT DOCUMENTS

| | | | |
|---|---|---|---|
| 2,781,321 | 2/1957 | Mayhew et al. | 252/556 |
| 2,988,511 | 6/1961 | Mills et al. | 252/121 |
| 3,070,547 | 12/1962 | Chaffee | 252/121 |
| 3,761,418 | 9/1973 | Parran | 252/106 |
| 4,234,464 | 11/1980 | Morshauser | 252/544 |
| 4,673,525 | 6/1987 | Small et al. | 252/132 |
| 4,946,618 | 8/1990 | Knochel et al. | 252/117 |

FOREIGN PATENT DOCUMENTS

| | | |
|---|---|---|
| 229443 | 6/1959 | Australia . |
| 791415 | 3/1956 | United Kingdom . |
| 945062 | 8/1961 | United Kingdom . |

*Primary Examiner*—Dennis Albrecht
*Attorney, Agent, or Firm*—Betty J. Zea; Leonard Williamson; Robert B. Aylor

[57] ABSTRACT

This invention is a mild personal cleansing bar comprising: from about 20% to about 50% lathering mild synthetic surfactant and from about 5% to about 50% of magnesium soap; wherein the ratio of said lathering mild synthetic surfactant to said soap is from about 10:1 to about 0.4:1; said bar having a pH of from about 6.5 to about 8.5 in a 1% aqueous solution at 25° C.

22 Claims, No Drawings

LOW PH MILD PERSONAL CLEANSING BAR WITH LATHERING MILD SYNTHETIC SURFACTANT AND MAGNESIUM SOAP

This is a continuation of application Ser. No. 07/668,578, filed on Mar. 13, 1991 now abandoned.

TECHNICAL FIELD

This invention relates to mild personal cleansing bars and to processes of making them.

BACKGROUND OF THE INVENTION

Personal cleansing with mild surface-active cleansing bar preparations has become a focus of great interest. The processability of such bars has also become a focus of great interest. The smear properties of such bars have become a focus of even greater interest.

Some of the problems associated with mild bars comprised of synthetic detergents are bar processability, firmness, smear and mildness. The problems of formulating such bars are not limited to the performance characteristics of the finished bars. Most bars which are made with certain mild surfactants are very difficult to fabricate.

In contrast, the fabrication of relatively pure "soap" bars is a well-worked-out engineering procedure involving milling, plodding and molding. Coco/tallow soap becomes quite plastic when warmed and can be easily plodded and molded under relatively low pressures.

Most synthetic detergents and detergent-filler combinations do not become plastic and the machinery for fabrication must be specially designed. See U.S. Pat. No. 2,678,921, J.A.V. Turck, Jr., issued May 18, 1954.

Ideal processing should be fast and problem free in terms of milling, plodding and molding toilet bar formation. Most mild bar processings fall short in this respect.

The development of soap-synthetic bars dates back to World War II. U.S. Pat. No. 2,432,169, Hoyt, describes a bar having soap and alkyl benzene sulfonate as the active and a substantial proportion of corn starch as a binder; and U.S. Pat. No. 2,988,511, Mills and Korpi, issued Jun. 13, 1961, describes a nonsmearing bar comprising alkyl glyceryl ether sulfonate, sodium and magnesium soaps and binder. U.S. Pat. No. 2,982,735, Blinka and Grounds, Jr, issued May 2, 1961, discloses a detergent milled bar comprising soap, anionic detergent and starch.

U.S. Pat. No. 2,781,321, Mayhew et al., issued Feb. 12, 1957, discloses (Example 19) a 50% Mg stearate all purpose detergent bar with 20% gum, etc. The surfactant system includes dodecylbenzene sulfonate in Examples 26–30, which is a relatively harsh surfactant. STPP is used at levels of 10–15% in Mayhew et al.'s examples.

U.S. Pat. No. 3,070,547, Chaffee, issued Dec. 25, 1962, also discloses a potassium synthetic soap-synthetic bar containing magnesium soap. There appears to be no free fatty acid in the Chaffee exemplified bars, and the pH's of his surfactant systems used in those examples are not disclosed, but are normally relatively high.

U.S. Pat. No. 2,987,484, Lundberg and Blinka, issued Jun. 6, 1961, discloses a closed die injection molded detergent bar comprising alkyl glyceryl ether sulfonate and acyl isethionate. Some other uses and procedures for making alkyl glyceryl ether sulfonate are disclosed in U.S. Pat. Nos.: 2,094,489, Hulter, issued Sep. 28, 1937; U.S. Pat. No. 2,427,576, Smith, issued Sep. 16, 1947; U.S. Pat. No. 2,427,577, Smith, issued Sep. 16, 1947; U.S. Pat. No. 2,989,547, Whyte, issued Jun. 20, 1961; U.S. Pat. No. 2,999,068, Pilcher et al., issued Sep. 5, 1961; and U.S. Pat. No. 3,024,273, Whyte et al., issued Mar. 6, 1962, all of said patents incorporated herein by reference.

It is noted that surfactant mildness can be measured by a skin barrier destruction test which is used to assess the irritancy potential of surfactants. In this test the milder the surfactant, the less the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; in U.S. Pat. No. 4,673,525, , Small et al., issued Jun. 16, 1987, and in copending U.S. patent application Ser. No. 294,832, Small et al., filed Jan. 9, 1989, incorporated herein by reference.

U.S. Pat. No. 2,894,912, Geitz, issued Jul. 14, 1959, for "Isethionate Detergent Bar," discloses a detergent bar consisting essentially of from 30–70% of water-soluble alkali metal detergent salts of esters of isethionic acid with mixed aliphatic fatty acids having from 6 to 18 carbon atoms and an iodine value of less than 20, of which mixed acids at least 75% have from 12 to 18 carbon atoms and up to 25% have from 6 to 10 carbon atoms, from 2–10% of at least one water-soluble suds-boosting detergent salt selected from the group consisting of alkali metal and organic amine higher aliphatic fatty alcohol sulfates, alkyl aryl sulfonates, and higher aliphatic fatty acid taurides, from about 1% to about 9% water, from about 2.5% to about 25% of water-soluble higher fatty acid soap, and from 10–40% of at least one higher fatty acid having from about 12 to about 25 carbon atoms as a binder and plasticizer, said bar having a pH within the range from 6 to 8, measured as a 10% aqueous solution of the bar composition at 35° C. No magnesium soap is used.

U.S. Pat. No. 4,180,470, Tokosh et al., issued Dec. 25, 1979, discloses a method for making improved 30–70% acyl isethionate detergent bars with from 2–6% of sodium alkoxy hydroxy propane sulfonate (a synonym for alkyl glyceryl ether sulfonate) with alkyl chains of from 8 to 22 carbon atoms in conjunction with a small amount of sodium chloride. $C_{18}$ alkyl glyceryl ether sulfonate at 5% is used in an example. The added alkyl glyceryl ether sulfonate and salt are used to improve bar wear rate without adversely affecting its lathering characteristics.

U.S. Pat. No. 4,234,464, Morshauser, issued Nov. 18, 1980, for "Detergent Bar Composition and Binder Therefor," discloses a detergent bar in Example 6 which comprises: 45% sodium cocoyl isethionate, 5% alkyl amide, 37.5% stearic acid, 5.0% hydrogenated tallow glycerides, and 1% Polymer JR. Morshauser teaches that his detergent bars can contain up to 5% soap "without substantial detriment."

U.S. Pat. No. 4,012,341, Orshitzer et al., issued Mar. 15, 1977, for a "Unique All Synthetic Detergent Shampoo Bar," discloses a bar comprising a mixture of anionic and nonionic detergents. The Examples are primarily based on sodium lauryl sulfate, which is an unacceptably harsh primary surfactant for the present invention.

U.S. Pat. No. 3,761,418, Parran, Jr., issued Sep. 25, 1973, for "Detergent Compositions Containing Particle Deposition Enhancing Atents," discloses detergent compositions including a bar, whose main surfactant is alkyl sulfate, which is unacceptable for the mild skin cleanser of the present invention.

Major drawbacks of most synthetic surfactant toilet bar formulations are harshness, poor lather, poor smear, and poor processability due to stickiness. The use of high sudsing anionic surfactants can yield acceptable lather volume. Unfortunately, the highest sudsing anionic surfactants are, in fact, poor in processability. While some prior art mild blends of sodium coconut/-tallow alkyl glyceryl ether sulfonate (AGS) are relatively good in lather potential, they are not so easy to process because of their stickiness or hygroscopicity. It will be appreciated that processability, firmness, smear, mildness, lather, and rinsability make surfactant selection for mild personal cleansing bars a delicate balancing act. Thus, it will be appreciated that rather stringent requirements for formulating mild personal cleansing bars limit the choice of surfactants, and final formulations represent some degree of compromise. Mildness is often obtained at the expense of processability, effective cleansing, lathering, or rinsing, or vice versa. Processability is often obtained at the expense of smear.

Needless to say, a superior processable mild personal cleansing bar formulation with good mildness, good smear, good lather potential and good rinsability is difficult to formulate.

OBJECTS OF THE INVENTION

An object of the present invention is to provide a stamped, mild personal cleansing bar which has improved processability.

Another object of the present invention is to provide a mild bar with excellent smear.

Yet another object is to formulate a mild personal cleansing bar with a relatively low level of free fatty acids to improve bar smear and bar firmness.

Other objects will become apparent from the detailed description below.

SUMMARY OF THE INVENTION

This invention is a mild personal cleansing bar comprising: from about 20% to about 50% lathering mild synthetic surfactant and from about 5% to about 50% of magnesium soap; wherein the ratio of said lathering mild synthetic surfactant to said soap is from about 10:1 to about 0.4:1; said bar having a pH of from about 6.5 to about 8.5 in a 1% aqueous solution at 25° C.

DETAILED DESCRIPTION OF THE INVENTION

The invention relates to a mild personal cleansing bar made from a mix of from about 20% to about 50% of a lathering mild synthetic detergent surfactant and from about 5% to about 50%, preferably from about 10% to about 45%, magnesium soap. The mild personal cleansing bar has a pH of from about 6.5 to about 8.5. The pH of the bar is preferably from 7 to 8, and is preferably adjusted with a carboxylic acid. The pH is measured as a 1% aqueous solution at about 25° C.

The ratio of lathering mild synthetic surfactant to the magnesium soap is from about 10:1 to about 0.4:1, preferably from about 5:1 to about 0.5:1, more preferably from about 4:1 to about 0.6:1.

The term "lathering mild synthetic surfactant" as used herein means any surfactant which lathers at least about as well as the "mild standard alkyl glyceryl ether sulfonate (AGS)," as defined herein, which contains a substantial amount of $C_{12}$ and $C_{14}$ alkyl chains, specifically about 68% $C_{12}$; 25% $C_{14}$; and 7% $C_{16}$ AGS.

A "non-lathering, non-soil-load-diluent, surfactant" is defined as a surfactant which has a "low" lather on the order of a $C_{16}$–$C_{18}$ alkyl glyceryl ether sulfonate, and other $C_{16}$–$C_{18}$ synthetic surfactants, e.g., $C_{16}$–$C_{18}$ alkyl sulfates, etc. These surfactants do not contribute to the lather in any appreciable way, but they also do not detract from the lather in any significant way. They are, however, especially effective in improving the ability of the bar to have a good grade in the Flex Test as described more fully hereinafter. They also are useful in improving the smear characteristics of the bars.

The terms "soil load diluent" and "hydrophobic material" as used herein are synonymous and mean any diluent which is a soil load on the order of free fatty acid, paraffin wax, fatty alcohol, or triglyceride. Some of these materials, like paraffin wax, are very effective in improving the Flex Test grades. Other materials, like free fatty acid, help plasticize the formula for processability.

The magnesium (Mg) soap can be made by using selected fatty matter (free fatty acids and soaps) having an Iodine Value of from zero to about 50, preferably below 15, and more preferably from about zero to about 3. The titer (in ° C.) can be as low as about 15, however, the preferred fatty matter of the soap and free fatty acid have a titer of from about 15 to 80, preferably from about 35 to 75, and more preferably from about 50 to about 70.

The chemical properties of some preferred pure saturated acids are set out below in the Pure Acid Table.

Pure Acid Table

| Acid | Chain Length | Acid Value | Molecular Weight | Titer °C. |
|---|---|---|---|---|
| Decanoic | C-10 | 326 | 172 | |
| Lauric | C-12 | 280 | 200 | 44.2 |
| Myristic | C-14 | 246 | 228 | 54.4 |
| Pentadecanoic | C-15 | 231 | 242 | |
| Palmitic | C-16 | 219 | 256 | 62.9 |
| Margaric | C-17 | 207 | 270 | |
| Stearic | C-18 | 197 | 284 | 69.6 |
| Nonadecanoic | C-19 | 188 | 298 | |
| Arachidic | C-20 | 180 | 312 | |
| Behenic | C-22 | 165 | 340 | |

Palm Kernel Acid Table (Typical)

| Acid | Chain Length | Wt. % |
|---|---|---|
| Saturated: | | |
| Octanoic | C-8 | 3 |
| Decanoic | C-10 | 3 |
| Lauric | C-12 | 50 |
| Myristic | C-14 | 18 |
| Palmitic | C-16 | 8 |
| Stearic | C-18 | 2 |
| Unsaturated: | | |
| Oleic | C-18 = 1 | 14 |
| Linoleic | C-18 = 2 | 2 |
| Iodine Value: | Low | 14 |
| | High | 23 |
| Saponification Value: | Low | 245 |
| | High | 255 |
| Titer, °C. (Fatty Acid): | Low | 20 |
| | High | 28 |

Palm Kernel Acid, Coconut Acid and Tallow Acid Tables show some chemical properties of those acids.

| Coconut Acid Table (Typical) | | |
|---|---|---|
| Acid | Chain Length | Wt. % |
| Saturated: | | |
| Octanoic | C-8 | 7 |
| Decanoic | C-10 | 6 |
| Lauric | C-12 | 50 |
| Myristic | C-14 | 18 |
| Palmitic | C-16 | 8.5 |
| Stearic | C-18 | 3 |
| Unsaturated: | | |
| Oleic | C-18 = 1 | 6 |
| Linoleic | C-18 = 2 | 1 |
| Linolenic | C-18 = 3 | 0.5 |
| Iodine Value: | Low | 7.5 |
| | High | 10.5 |
| Saponification Value: | Low | 250 |
| | High | 264 |
| Titer, °C. (Fatty Acid): | Low | 20 |
| | High | 24 |

| Tallow BFT Table (Typical) | | |
|---|---|---|
| Acid | Chain Length | Wt. % |
| Saturated: | | |
| Myristic | C-14 | 3 |
| Pentadecanoic | C-15 | 0.5 |
| Palmitic | C-16 | 24 |
| Margaric | C-17 | 1.5 |
| Stearic | C-18 | 20 |
| Unsaturated: | | |
| Myristoleic | C-14 = 1 | 1 |
| Palmitoleic | C-16 = 1 | 2.5 |
| Oleic | C-18 = 1 | 43 |
| Linoleic | C-18 = 2 | 4 |
| Linolenic | C-18 = 3 | 0.5 |
| Iodine Value: | Low | 45 |
| | High | 50 |
| Saponification Value: | Low | 192 |
| | High | 202 |
| Titer, °C. (Fatty Acid): | Low | 40 |
| | High | 45 |

The free fatty acid (and other soil load diluents) in the mild personal cleansing bar of the present invention can be surprisingly low. The Mg soap to FFA ratio can be from about 50:1 to about 0.5:1, preferably from about 30:1 to about 1:1, and more preferably from about 15:1 to about 2:1. The level of FFA is preferably from about 1% to about 10%, preferably from about 2% to about 9%, more preferably from about 3% to about 8%, of the bar.

The hydrophobic material (soil load diluents) can be present in the bars of this invention at a level of from zero up to about 40%, but is preferably used at a level of from about 5% to about 20%. The other hydrophobic material including free fatty acids containing from about 8 to about 18 carbon atoms; mono-, di-, and triglycerides; fatty alcohols containing from about 8 to about 18 carbon atoms; and mixtures thereof; wherein said composition contains about 25% maximum of said waxes and about 15% maximum of said other hydrophobic material. Triglycerides ($C_8$–$C_{18}$ acyl chain) can be used up to about 10% wit%out adversely affecting acceptable lather performance.

The preferred hydrophobic material %s a wax having a melting point (M.P.) of from about 120° F. to about 185° F. (49° C.–85° C.), preferably from about 125° F. to about 175° F. (52° C.–79° C.). A preferred paraffin wax is a fully refined petroleum wax having a melting point ranging from about 130° F. to about 140° F. (49° C.–60° C.). This wax is odorless and tasteless and meets FDA requirements for use as coatings for food and food packages. Such paraffins are readily available commercially. A very suitable paraffin can be obtained, for example, from The Standard oil Company of Ohio under the trade name Factowax R-133.

Other suitable waxes are sold by the National Wax Co. under the trade names of 9182 and 6971, respectively having melting points of 131° F. and 130° F. (~55° C.).

The paraffin preferably is present [n the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount randing from about 0.5% to about 5% by weight. The microcrystalline wax ingredient imparts pliability to the bar at room temperatures.

The non-soil-load, surfactant diluent can be used at a level of from 0% to about 40%, preferably from about 5% to about 40%, and more preferably from about 10% to about 35%. The latter level range is highly preferred for Flex Test mildness.

The water level is from about 2% to about 15%, preferably from about 4% to about 10%.

The total non-surfactant electrolyte (organic and inorganic) level is from about 1% to about 10%, preferably from about 2% to about 8%, more preferably from about 2% to about 5%, by weight of the bar.

Numerous examples of surfactants are disclosed in the patents incorporated herein by reference. They include alkyl sulfates, anionic acyl sarcosinates, methyl acyl taurates, N-acyl glutamates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these surfactants are $C_8$–$C_{22}$, preferably $C_{12}$–$C_{14}$ for lathering mild surfactants, and $C_{16}$–$C_{18}$ for non-lathering non-soil-load diluents.

The term "alkyl glyceryl ether sulfonate" as used herein means, in general, a mixture of alkyl glyceryl ether sulfonate (AGS) surfactants having alkyl chains of from 8–22 carbon atoms, preferably from 10–20 carbon atoms, and more preferably from 12–14 carbon atoms.

Alkyl glyceryl ether sulfonates are derived from corresponding ethers consisting of straight alkyl chains which are in turn derived from their corresponding synthetic or natural alcohols.

Commonly assigned U.S. Pat. No. 4,673,525, Small et al., supra, discloses a mild alkyl glyceryl ether sulfonate surfactant based mild personal cleansing bar comprising alkyl glyceryl ether sulfonate. The mild personal cleansing bars of this invention exhibit improved processability over the exemplified mild personal cleansing bars disclosed in Small et al. In other words, the improved bars of this invention also exhibit a processability improvement over comparable AGS soap bars. The bars of this invention are also better in terms of bar firmness and smears.

Alkyl glycosides and methyl glucose esters are preferred mild nonionics which may be mixed with at least one of said mild anionic or amphoteric surfactants in the compositions of this invention.

A preferred ingredient is acyl isethionate. Acyl isethionates are aliphatic higher fatty acid esters of an alkali metal isethionic acid salt and can be defined by the following general formula: $RCOOCH_2CH_2SO_3M$ wherein R is an aliphatic radical or mixed aliphatic radical of a higher fatty acid or mixture thereof, having from about 6 to about 20 carbon atoms, preferably from about 8 to about 18 carbon atoms, e.g., cocoyl or an approximately equivalent distribution of chain lengths, the longer chains (16 and 18) being more preferred as non-lathering, non-soil-load diluents and medium chain ($C_{12}$–$C_{14}$) being more preferred as lathering synthetic surfactants; and wherein M is an alkali metal cation such as sodium, potassium, or ammonium, or an organic amine base such as triethanolamine, triisopropanolamine, diethanolamine and ethanolamine. The preferred cation in the AGS and the acyl isethionate salts is sodium.

A preferred milled bar for Flex Test mildness comprises: (1) from about 5% to about 25%, preferably from about 10% to about 20%, of $C_{16}$–$C_{18}$ alkyl (chain) sulfates and (2) from about 5% to about 50%, preferably from about 10% to about 30% magnesium soap by weight of the soap bar. E.g., Example 7 disclosed hereinbelow. Lathering mild synthetic surfactants are also required in this preferred bar. The ratio of the alkyl sulfates to magnesium soap can be from about 3:1 to about 1:6, preferably from about 1:2 to about 1:4. This non-soil-load, non-lathering, synthetic surfactant diluent is a surprisingly and unexpectedly excellent or superior diluent for lathering ultra mild synthetic surfactants, e.g., alkyl glyceryl ether sulfonate and/or cocoyl isethionate in personal cleansing bar compositions. The synthetic surfactant diluents provide a surprisingly acceptable improvement in bar processability, while not significantly impairing bar mildness or the desirable physical characteristics of the bars.

The $C_{16}$–$C_{18}$ alkyl sulfates are derived from corresponding saturated straight chain alcohols. The $C_{16}$–$C_{18}$ alkyl sulfates, as defined herein, comprise said $C_{16}$–$C_{18}$ alkyl chains at a level of at least about 90%, preferably about 93%, and more preferably about 97%. In general, the ratio of $C_{16}$ to $C_{18}$ can range from about 4:1 to about 1:4 by weight. A commercially available $C_{16}$–$C_{18}$ alkyl sulfate is SIPON® EC-111 (formerly SIPEX® EC-111), sodium cetearyl sulfate, which is approximately 60% $C_{16}$ and 36% $C_{18}$. SIPON® EC-111 is sold by Alcolac Company, Baltimore, MD 21226. Another source is Henkel Corp., Ambler, PA 19002. Henkel's sodium cetearyl sulfate, LANETTE E, is an estimated 50–50% $C_{16}$–$C_{18}$ alkyl sulfate sold as an emulsifier.

The percentages, ratios, and parts herein are on a total composition or surfactant weight basis, unless otherwise specified. All formulae, levels and ranges herein are approximations unless otherwise specified. Some preferred percentages and ratios are described below.

The lathering synthetic surfactant comprises from 20% to 50% by weight of the bars of this invention. A preferred bar comprises: about 25% to 45% lathering mild synthetic surfactant; about 15% to 20% of non-soil-load synthetic surfactant diluent, e.g., cetearyl sulfate; about 10% to 50% magnesium soap; and about 1% to 10%, preferably 2% to 9%, free fatty acid; about 0% to 8%, preferably 0.2% to 2%, polymeric skin feel aid; and 2% to 15%, preferably 4% to 10%, water.

The bars of the present invention comprise a soil load diluent (FFA, wax, etc.) to lathering mild synthetic surfactant ratio of from 0.1:1 to 1:1, preferably from 0.2:1 to 0.9:1.

The bars of the present invention comprise a soil load diluent to a non-soil-load diluent (including Mg soap) ratio of from 0.1:1 to 1:1, preferably from 0.2:1 to 0.9:1, and without Mg soap the ratio is 0.4:1 to 30:1.

The bars of the present invention comprise a lathering synthetic surfactant to a non-soil-load diluent (with Mg soap) ratio of from 0.2:1 to 3:1, preferably from 0.3:1 to 2:1, and without Mg soap the ratio is 0.5:1 to 35:1.

The bars of the present invention comprise a magnesium soap to lathering synthetic surfactant ratio of from 1:10 to 1:0.4, preferably from 1:5 to 1:0.5, more preferably from 1:4 to 1:0.6.

The bars of the present invention comprise a magnesium soap to total synthetic surfactant(s) (lathering+diluent) ratio of from 0.1:1 to 3:1, preferably from 0.2:1 to 2:1, and more preferably from 0.3:1 to 1.5:1.

The bars of the present invention comprise a magnesium soap to free fatty acid ratio of from 50:1 to 0.5:1, preferably from 30:1 to 1:1, more preferably from 15:1 to 2:1.

The bars of the present invention comprise a magnesium soap to a soil load diluent (FFA, wax, etc.) ratio of from 0.3:1 to 5:1, preferably from 0.4:1 to 4:1.

For improved smears, it should be noted that when the magnesium soap level is low, e.g., 10% or less, and when the level of the total synthetic surfactant(s) to magnesium soap is more than 5:1, the water level of the bar should be from about 2% to about 7%, preferably from about 2.5% to about 6% for improved smear.

More than one lathering synthetic surfactant can be used. E.g., from about 2% to about 25%, preferably from about 3% to about 20%, more preferably from about 4% to about 16%, of very high lather enhancing surfactant, e.g., sodium lauroyl sarcosinate can be used with AGS, as shown in the Examples herein.

Other bar ingredients are selected from: non-lathering diluent surfactants, magnesium soap, soil load diluents, polymeric skin feel aids, moisturizers, fillers, etc.

The mild personal cleansing bars can also have about 0–8%, preferably about 0.2–2%, polymeric skin feel aid if present.

A preferred bar of this invention can comprise about 0.1% to 5%, more preferably 0.2% to 2%, of a suitably fast hydrating cationic polymer. The polymers have molecular weights of from about 1000 to about 3,000,000. A preferred one is selected from cationic guar gums having a molecular weight range of 2,500–350,000.

The cationic polymer (skin conditioning agent) is selected from the group consisting of:

(I) cationic polysaccharides;

(II) cationic copolymers of saccharides and synthetic cationic monomers, and (III) synthetic polymers selected from the group consisting of:

(A) cationic polyalkylene imines (B) cationic ethoxy polyalkylene imines, and (C) cationic poly[N-[-3-(diemethylammonio)propyl]-N'-[3-(ethyleneoxyethylene dimethylammonio)-propyl]urea dichloride].

Specific examples of members of the cationic polysaccharide class include the cationic hydroxyethyl cellulose JR 400 made by Union Carbide Corporation; the cationic starches Stalok® 100, 200, 300 and 400 made by Staley, Inc.; the cationic galactomannans based on guar gum of the Galactasol 800 series by Henkel, Inc. and the Jaguar Series by Celanese Corporation.

Examples of members of the class of copolymers of saccharides and synthetic cationic monomers include those composed of cellulose derivatives (e.g., hydroxyethyl cellulose) and N,N-diallyl,N-N-dialkyl ammonium chloride available from National Starch Corporation under the trade name Celquat.

The cationic synthetic polymers useful in the present invention are cationic polyalkylene imines, ethoxypolyalklene imines, and poly[N-[-3-(dimethylammonio)-propyl]-N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by Celanese Corporation. In order to achieve the benefits described in this invention the polymer must have characteristics, either structural or physical which allow it to be suitably and fully hydrated and subsequently well incorporated into the soap matrix.

Other ingredients of the present invention are selected for the various applications. E.g., perfumes can be used in formulating the skin cleansing products, generally at a level of from about 0.1% to about 1.5% of the composition. Alcohols, hydrotropes, colorants, and fillers such as talc and clay, can also be used. Preservatives, e.g., sodium ethylenediaminetetraacetate (EDTA), generally at a level of less than 1% of the composition, can be incorporated in the cleansing products to prevent microbiological growth. Antibacterials can also be incorporated, usually at levels up to 1.5%.

A preferred bar of the present invention can contain from about 0.5% to about 4%, preferably from about 2% to about 3.5%, trisodium phosphate.

The following patents disclose or refer to such ingredients and formulations which can be used in the mild personal cleansing bars of this invention, and are incorporated herein by reference:

| Pat. No. | Issue Date | Inventor(s) |
|---|---|---|
| 4,234,464 | 11/1980 | Morshauser |
| 4,061,602 | 12/1977 | Oberstar et al. |

-continued

| Pat. No. | Issue Date | Inventor(s) |
|---|---|---|
| 4,472,297 | 9/1984 | Bolich et al. |
| 4,491,539 | 1/1985 | Hoskins et al. |
| 4,540,507 | 9/1985 | Grollier |
| 4,673,525 | 6/1987 | Small et al. |
| 4,704,224 | 11/1987 | Saud |
| 4,812,253 | 3/1989 | Small et al. |
| 4,820,447 | 4/1989 | Medcalf et al. |

The magnesium soaps can be added as is, or made in situ, e.g., via adding a base, e.g., Mg(OH)2, to convert free fatty acids in the composition mix.

In another preferred (suitable) method of preparing bars of the present invention, the synthetic detergent, neutralized with a solution of an alkali metal hydroxide or carbonate, to which the salting-out electrolyte has been added (if insufficient electrolyte will be formed in situ during the neutralization step and in other steps of the process), is introduced into a suitable mixer, such as a soap crutcher. Some water can then be added to improve fluidity, and a sodium soap, preferably as soap containing about 30% water, is added. These ingredients are mixed and then an appropriate amount of water-soluble alkaline earth metal salt, such as magnesium sulfate or chloride, or calcium chloride, is added to convert a portion of the water-soluble soap to water-insoluble soap, sodium salting-out electrolyte being formed as by-product. In a preferred method, the magnesium soap is made before the synthetic surfactant is added to the mix. Mixing is then continued to insure the equilibrium in the formation of the magnesium soap is attained. Desirable adjustments in water-soluble soap content may, of course, be made after the magnesium soap has been formed.

Two Preferred Processes for Making a Preferred Mild Personal Cleansing Bar

I. Crutching—Neutralization

1. Add predetermined quantity of AGS paste at 65° C. (150° F.) to the crutcher.
2. Outside the crutcher, add the predetermined quantity of NaCl and $Na_2SO_4$ to enough hot water at 75° C. (167° F.) to get the final crutcher moisture up to 50%, accounting for all other raw material moisture content. After dissolution of the electrolytes in the hot water, add the mixture to the crutcher.
3. Turn the agitator and recirculation pump (optional) on and maintain a crutcher temperature of 75° C.–85° C. (167° F.–185° F.) by adjusting steam and water valves.
4. Add predetermined amount of $TiO_2$ powder to the crutcher.
5. Add predetermined amount of $Mg(OH)_2$ powder at ambient temperature to the crutcher. A slurry of this material may also be used. Mix until powder is visibly distributed fully.
6. Add predetermined amount of fatty acid to the crutcher to produce magnesium soap. Ideally, the acid should be in a molten form at 75° C.–85° C. (167° F.–185° F.). If added as a powder, continue mixing until powder is visibly melted.
7. Add predetermined quantity of sarcosinate solution at ambient temperature to the crutcher. Allow crutcher to return to target temperature.
8. Add predetermined quantity of molten paraffin at 75° C.–85° C. (167° F.–185° F.) to the crutcher. If flakes of paraffin are added, allow paraffin to melt completely.

9. Allow contents of crutcher to completely mix and react until the pH of the crutcher reaches a target of 7.3–8.0, while maintaining the crutcher temperature at 75° C.–85° C. (167° F.–185° F.). This typically takes 20–40 minutes.
10. Add predetermined quantity of excess fatty acid, at a temperature consistent with the previous fatty acid addition. Allow the crutcher to mix for an additional 10 minutes.

II. Crutching—Ion Exchange

1. In the crutcher, put the required amounts of soap, fatty acids and triglyceride at 82° C.–88° C. (180° F.–190° F.) and mix until homogeneous, approximately 10 minutes.
2. Solubilize the $MgCl_2$ in water and add to the crutcher. Continue to mix at 82° C.–88° C. (180° F.–190° F.) until reaction is complete, approximately 10 minutes.
3. Add the liquid sodium lauroyl sarcosinate, the sodium cocoyl glyceryl ether sulfonate, and the amine oxide to the crutcher, maintaining the temperature at 82° C.–88° C. (180° F.–190° F.). Mix until homogeneous, approximately 10 minutes.
4. Add the desired amount of Polyoxyethylene WSR-35 and mix for 5 minutes.

Drying for Both I and II

The crutcher mix is dried and cooled using a combination flash chamber and chill roll or chill belt. The crutcher mix is first heated to approximately 132° C. (270° F.) by a heat exchanger and then flash dried in a chamber above the chill roll or chill belt. From the flash chamber the hot, dried mix is extruded onto the chill roll or chill belt. The chill belt or chill roll provides a uniform, thin, cool (29° C.–35° C., 85° F.–95° F.) product in flake or chip form. Typical moisture for the flake is 2–12%, preferably 6–8%. The ways to regulate the moisture, in the order of preference, are (1) increasing or decreasing steam pressure on the heat exchanger; (2) increasing or decreasing crutcher mix rate to the heat exchanger; and (3) increasing or decreasing crutcher mix temperature to the heat exchanger.

Amalgamating

The flakes are weighed and mixed in a batch amalgamator to obtain uniform flake size. Preweighed perfume is added to the flakes and mixed in the amalgamator to obtain the desired finished product perfume level. The perfumed flakes are transferred to the mill hopper or directly to the plodder.

Milling (Optional)

The 3-roll soap mills are set up with the first roll at 38° C. (100° F.) and the other two mills at about 21° C. (70° F.). The soap is passed through the mills several times to provide a homogeneous mixture of perfume and dried flakes.

Plodding and Stamping

The plodder is set up with the barrel temperature at about 21° C. (70° F.) and the nose temperature at 38° C.–49° C. (100° F.–120° F.). The ideal plodder is a dual stage plodder that allows use of a vacuum of about 15–25 inches of Hg. The plugs should be cut in 5" sections and stamped with a cold die block using die liquor such as alcohol, if appropriate.

EXAMPLES

The following examples and methods are illustrative and are not intended to limit the scope of the invention(s). The detailed methods of making and purifying generic alkyl glyceryl ether sulfonate per se are disclosed in U.S. Pat. No. 2,988,511, supra, incorporated herein by reference. The percentages, ratios, and parts herein are on a total composition or surfactant weight basis, as indicated, unless otherwise specified. All levels and ranges, temperatures, results etc., are approximations unless otherwise specified.

The mild personal cleansing bars of Examples 1–7 are made using the above preferred crutching neutralization process. Example 8 is made by adding magnesium chloride to Na soap to form the Mg soap by ion exchange before mixing with the synthetic surfactants. Comparative Example A is made similar to the bars of Examples 1–7, except that sodium hydroxide is used instead of $Mg(OH)_2$ and is used as a standard for the mildness and smears. Comparative Example B is the "B" bar and is used as a second standard for the mildness and smears. Comparative Example C is a leading commercial all soap bar and is used as a standard for typical all soap bars. Example 3 is the preferred overall bar for mildness, lather, and smears.

Two bar smear tests are disclosed below, the "Mush Smear 1" and the "Bar Character Smear 2."

Mush Smear "1" Test Procedure

Equipment

1. #2-022C Fisher Brand Hexagonal Polystyrene weighing dishes (4"×3").
2. #14-366A Fisher Brand Spatula.
3. Balance capable of weighing to two decimal points.
4. 120° F. Temperature Room.
5. Timer.

Test Method

1. Label and weigh the number of weighing dishes needed (two weighing dishes per sample, one labeled M for mush dish, one labeled S for soak dish).
2. Weigh the original bar and record the weight. Place bar in preweighed dish labeled S.
3. Add 30 mls room temperature city water to the dish containing the bar prototype (pour water down side of weighing dish). Add 30 mls room temperature city water to the dish containing the control bar. When placing the bars in the dish make sure the bars are not touching the sides of the dishes.
4. Allow bars to soak in weighing dishes at room temperature for 2 hours undisturbed.
5. After 2 hours of soaking, pick bar up carefully and allow to drain into the same dish for 15 seconds.
6. After 15 seconds, invert bar and place in preweighed dish labeled M.
7. Weigh soaked bar and record.
8. Scrape the wet surface or mush from the bar, with a spatula, into the same preweighed dish labeled M, weigh and record. Best results for scraping are seen when the spatula is held loose in hand being careful not to gouge the bar or to scrape too deeply. When the surface of the bar no longer appears to look wet or shiny, scraping is completed. To eliminate variability of scraping from person to person, results from each test will be reported relative to the control placed in that test.

9. Weigh and record the scraped bar.
10. Place the soak dish, the mush dish, and the scraped bar in the 120° F. Temperature Room for water evaporation for 48 hours.
11. After 48 hours, weigh and record the dry weight of the soak dish, the mush dish and the scraped bar.
12. Calculate the surface area of the scraped portion of the bar by measuring (in inches) length times width.
13. Add the number of dry grams of mush (smear) to the number of dry grams of soak. This is the overall result in grams.

All series of testing should include control, and all samples should be run in duplicates. A maximum of 7 products (6 plus a control) can be tested at one time, and an interval of 10 minutes between every 4 samples should be allotted for the addition of water as to not allow any products a lag time for soaking longer than 2 hours.

Bar Character Smear "2" Test 5 ml Smear Test

Equipment

"Alathon" soap dishes
Small measuring cylinder

Method

1. Wet soap bar to be tested by dipping surface to be soaked in distilled water and shaking off excess water. This procedure leads to more uniform bar smear.
2. Place bar centrally on "Alathon" dish containing 5 ml of distilled water. Rock dish to break water tension. The Alathon dish was selected as being a standard, readily available (in U.S.) dish with low ridges.
3. Store overnight (approximately 18 hours) in standard conditions of temperature and humidity (27° C./80° F./80% RH were used). As this test measures the bar's ability to recover as well as absorb water, standard conditions avoid seasonal variations which may occur in uncontrolled laboratory overnight conditions.
4. Next morning, remove bar with a careful vertical lift and invert for judging.

Judging

Bar Smear—Each judge grades soap bar smear by fingering the bar and taking into account both types of smear and amount of smear.

| Grade | Smear Description |
|---|---|
| 10 | Excellent |
| 9 | Very good smear |
| 8 | Good smear (Target) |
| 7 | Slightly poorer than desired |
| 6 | Marginal but still acceptable |
| 5 | Minimum acceptable smear |
| 4 | Poor and unacceptable |
| 3 | Very poor smear |
| 2 | Poorest normally seen |
| 1 | Extremely poor smear |

Clinical Assessment of the Toilet Bars

The clinical test procedure used to evaluate several toilet bar formulations for skin mildness is given below.

Mildness Forearm Wash Test Procedure

The washings are performed by a technician. Each panelist is assigned a set of 8 products for washings, 4 per arm. The test procedure for each arm is:

Protocol

1. Place 3M Micropore surgical tape with 4 precut 3.2 cm diameter holes on the volar forearm. Center tape on the lower inner forearm trying to keep the lower treatment area away from the wrist area.
2. Wet the forearm with warm (35° C.–40° C.) water.
3. Wet a nonwoven paper towel (Masslinn Towel, Chicopee Mills, New Brunswick, New Jersey) with warm water. Rub the towel on the appropriate test product using a circular motion for 6 seconds.
4. Rotate the towel at each test site for 10 seconds.
5. Allow lather from the test products to remain on the test site for 90 seconds.
6. Rinse each site with warm water (35° C.–40° C.) for 15 seconds.
7. Pat area dry with soft, disposable (BOUNTY®) paper towel.
8. Wait 2 minutes and repeat above procedure for a second time.
9. This procedure is to be followed 2 times daily, for 4 consecutive days, and 1 time the final day of the study, for a total of 17 washings. Each of the daily visits will be approximately 3 hours apart. A visual inspection of each test site is to be made just prior to the second wash procedure of the third day and 3 hours after the final wash of the fifth day. Observable dryness and erythema will be scored at each examination period.
10. The following grading scales are used:

Clinical Test Skin Grading Scales

The forearm skin grading scales reported herein are set out below.

Forearm Grading Scale—Skin Dryness

0 Perfect skin.
1.0 Patches of checking and/or slight powderiness and occasional patches of small scales may be seen. Distribution generalized.
2.0 Generalized slight powderiness. Early cracking or occasional small lifting scales may be present.
3.0 Generalized moderate powderiness and/or moderate cracking and lifting scales.
4.0 Generalized heavy powderiness and/or heavy cracking and lifting scales.
5.0 Generalized high cracking and lifting scales. Eczematous change may be present. Powderiness may be present but not prominent. May see bleeding crack.
6.0 Generalized severe cracking. Eczematous change may be present. Bleeding cracks may be present. Scales large, may be beginning to disappear.

Forearm Grading Scales—Skin Erythema

0 No redness
1.0 Barely detectable redness
2.0 Slight redness
3.0 Moderate redness
4.0 Heavy or substantial redness
5.0 Severe redness
6.0 Extreme redness The term "generalized" as used herein means that more than 50% of the surface area of the forearm exhibits the attribute. Whole unit skin grades reflect generalized condition. Half units are used to represent intermediate conditions.

Flex Test Wash

Protocol

1. Wet one sponge under warm, about 37° C. (95° F.–100° F.) water until completely wet.
2. Squeeze the sponge 3–4 times to remove excess water.
3. Lather the moistened sponge, in a circular motion, directly on the test bar for 10 seconds.
4. Wash the appropriate test areas of the inner volar forearm for 60 seconds (i.e., washing motions of 2–3 circular revolutions per second).
5. Thoroughly rinse the wash area and pat dry with a paper towel (15-second rinse recommended).
6. This procedure is to be followed 3 times daily for 5 consecutive days for a total of 15 washings. Each of the daily wash procedures will be approximately 2 hours apart. A visual inspection of each test site is to be made just prior to the next wash procedure. Observable erythema will be scored at each examination period. The final examination is to be made about 2 hours following the last wash procedure.
7. The following erythema scoring scale is to be used:
   0=no evidence of erythema
   1=slight erythema (spotty and/or minimally perceptible)
   2=moderate erythema (more uniform, pink-red)
   3=marked erythema (uniform, relatively brighter or deeper red)
   Intermediate 0.5, 1.5, 2.5, and 3.5 increments may also be scored with necessary.
8. Arms are no longer subjected to the washing procedure if a rating of "2" or greater is attained. The score of "2" is assigned for the remainder of the study.
9. Products are statistically compared by examining the number of Grade 2 or higher ratings. The fewer the number of these ratings, the milder the product is judged to be.

In the following Examples, which include magnesium soap, some or all of the magnesium soap can be replaced with other alkaline earth metal soap such as calcium, zinc, aluminum, and other soaps, which are substantially insoluble on the order of magnesium soap.

TABLE 1

| Ingredient | Ex. 1 Wt. % | Ex. 2 Wt. % | Ex. 3 Wt. % | Ex. 4 Wt. % |
|---|---|---|---|---|
| Magnesium Soap | | | | |
| (Cocoate) | — | 33.0 | — | — |
| (Laurate) | 29.7 | — | — | 22.5 |
| (Stearte*) | — | — | 38.0 | — |
| (75 Tallow/25 Palm Kernelate) | — | — | — | — |
| Sodium Soap (50 Tallow/50 Palm Kernelate) | 1.4 | — | — | — |
| Sodium Cetearyl Sulfate | 11.8 | — | — | — |
| Sodium Cocoyl Glyceryl Ether Sulfonate | 15.7 | 25.0 | 21.0 | 40.9 |
| Sodium Lauroyl Sarcosinate | 6.9 | 7.0 | 12.0 | 7.5 |
| $C_{12-13}$ Alkyldimethyl Amine Oxide | — | — | — | — |
| Lauric Acid | 2.9 | — | 3.0 | 3.2 |
| Coconut Acid | — | 3.0 | — | — |
| Sodium Chloride | 1.0 | 1.0 | 1.5 | 1.5 |
| Sodium Sulfate | 1.5 | 1.5 | 1.85 | 1.5 |
| Paraffin (M.P. 55° C.) | 14.7 | 17.0 | 10.0 | 10.7 |
| Triglyceride I-8 Hardstock | — | — | — | — |
| Polyoxyethylene WSR-35 | — | — | — | — |
| Titanium Dioxide | 0.2 | 0.2 | 0.2 | 0.2 |
| Fragrance | 1.0 | 1.0 | 1.0 | 1.0 |
| Water | 10.1 | 8.7 | 9.3 | 6.8 |
| Miscellaneous | 3.1 | 2.6 | 1.7 | 4.2 |
| Totals | 100.0 | 100.0 | 100.0 | 100.0 |

*Emersol 132 (Emery Industries) is really a mixture of stearate and laurate having a titer of about 55 and a maximum I.V. of 0.5.

| | Ex. 1 | Ex. 2 | Ex. 3 | Ex. 4 |
|---|---|---|---|---|
| Smear 1 (Mush Smear "1" Test described below) | | | | |
| Wet (grams)* | 0.66 | 1.44 | 1.51 | 1.93 |
| Dry (grams) | 0.58 | 0.52 | 1.11 | 0.86 |
| Average | 0.62 | 0.98 | 1.31 | 1.40 |
| Smear 2 (Method described below) | | | | |
| 5 ml.** | 7.5 | 7.5 | 6.5 | 7.5 |
| pH | 8.02 | 7.45 | 7.55 | 7.41 |
| Soap/FFA ratio | 10:1 | 11:1 | 12.2:1 | 7:1 |

*Lower numbers the better.
**Higher numbers the better.
The totals for: lathering mild synthetic surfactant; magnesium soap; non-soil-load, non-lathering surfactant; and soil load diluent for Examples 1–4 are as follows:

| Totals | Ex. 1 | Ex. 2 | Ex. 3 | Ex. 4 |
|---|---|---|---|---|
| Mild Lathering Synthetic Surfactant | 21.5 | 30.25 | 31.53 | 45.54 |
| Magnesium Soap | 29.7 | 33.0 | 38.0 | 22.5 |
| Non-Soil, Non-Lathering Diluent (including Mg Soap) | 42.6 | 34.75 | 39.47 | 25.36 |
| Soil Load Diluent (FFA, Wax, Triglyceride) | 17.68 | 20.0 | 13.0 | 13.9 |
| Mg Soap/Total Synthetic | 0.9:1 | 1:1 | 1.15:1 | 0.5:1 |

| Ingredient | Ex. 5 Wt. % | Ex. 6 Wt. % | Ex. 7 Wt. % | Ex. 8 Wt. % |
|---|---|---|---|---|
| Magnesium Soap | | | | |
| (Cocoate) | — | — | — | — |
| (Laurate) | 12.8 | 24.0 | — | — |
| (Stearte*) | — | — | 10.0 | — |
| (75 Tallow/25 Palm Kernelate) | — | — | — | 27.6 |
| Sodium Soap (50 Tallow/50 Palm Kernelate) | — | — | — | — |
| Sodium Cetearyl Sulfate | 32.1 | — | 14.0 | — |
| Sodium Cocoyl Glyceryl Ether Sulfonate | 17.1 | 35.0 | 32.0 | 13.6 |
| Sodium Lauroyl Sarcosinate | 7.4 | 7.0 | 10.0 | 15.9 |
| $C_{12-13}$ Alkldimethyl Amine Oxide | — | — | — | 2.3 |
| Lauric Acid | 3.2 | 3.0 | 5.0 | — |
| Coconut Acid | — | — | — | 7.9 |
| Sodium Chloride | 1.5 | 1.5 | 1.5 | 3.7 |
| Sodium Sulfate | 1.5 | 1.5 | 1.85 | 0.6 |
| Paraffin (M.P. 55° C.) | 12.6 | 13.0 | 13.0 | — |
| Triglyceride I-8 Hardstock | — | — | — | 16.1 |
| Polyoxyethylene WSR-35 | — | — | — | 0.4 |
| Titanium Dioxide | 0.2 | 0.2 | 0.2 | 0.25 |
| Fragrance | 1.0 | 1.0 | 1.0 | 1.0 |
| Water | 7.4 | 10.2 | 7.5 | 9.0 |
| Miscellaneous | 3.2 | 3.6 | 3.9 | 1.6 |
| Totals | 100.0 | 100.0 | 100.0 | 100.0 |

*Emersol 132 (Emery Industries)

| | Ex. 5 | Ex. 6 | Ex. 7 | Ex. 8 |
|---|---|---|---|---|

TABLE 1-continued

| | | | | |
|---|---|---|---|---|
| Smear 1 | | | | |
| Wet (grams)* | 2.35 | 2.38 | 4.26 | N/A |
| Dry (grams) | 1.37 | 1.64 | 2.00 | N/A |
| Average | 1.86 | 2.01 | 3.10 | N/A |
| Smear 2 | | | | |
| 5 ml.** | 7.5 | 7.0 | 6.5 | 8.0 |
| pH | 7.97 | 7.57 | 7.59 | 8.00 |
| Soap/FFA ratio | 4:1 | 8:1 | 2:1 | 3.5:1 |

*Lower numbers the better.
**Higher numbers the better.
N/A = Not available.

The total level of synthetic surfactants in Example 7 is 56%, and the water level is 7.5%; the ratio of Mg soap to total synthetic is 0.18:1. The smears could be improved in Example 7 by lowering the water level to below about 7%. Note that Example 5 which has a total synthetic of 56.6% and a Mg soap to total synthetic ratio of 0.22:1 but has a higher Mg soap level, 12.8% vs. 10%, has a better smear, notwithstanding equal water levels for Examples 5 and 7.

For improved smears, it should be noted that when the magnesium soap level is low, e.g., 10% or less, and when the level of the total synthetic surfactant(s) to magnesium soap is more than 5:1, the water level of the bar should be from about 2% to about 7%, preferably from about 2.5% to about 6% for improved smear.

TABLE 2

| COMPARATIVE EXAMPLES A-C | | | |
|---|---|---|---|
| Ingredient | Ex. A Wt. % | Ex. B Wt. % | Ex. C Wt. % |
| Sodium $C_{12}/C_{14}/C_{16}/C_{18}$ - 58/21/10/9% (AGS) | 48.2 | — | — |
| Sodium Lauroyl Sarcosinate | 12.5 | — | — |
| Sodium Cocoyl Isethionate | — | 49.1 | — |
| Sodium Linear Alkylbenzene Sulfonate | — | 2.0 | — |
| Lauric Acid | 6.5 | — | — |
| Stearic Acid | 9.8 | 25.0 | — |
| Sodium Chloride | 5.3 | 0.5 | 0.81 |
| Sodium Sulfate | 1.3 | — | — |
| Sodium Isethionate | — | 6.0 | — |
| Sodium Soap | | | |
| (60 Stearate/40 Laurate) | 7.2 | 12.0 | — |
| (85 Tallow/15 Cocoate) | — | — | — |
| (75 Tallow/25 Cocoate) | — | — | 75.25 |
| Titanium Dioxide | 0.25 | 0.4 | — |
| Fragrance | 1.0 | 1.0 | 0.16 |
| Water | 3.5 | 4.0 | 23.5 |
| Miscellaneous | 4.4 | — | 0.28 |
| Totals | 100.0 | 100.0 | 100.0 |

Comparative Example A is an ultra mild bar having fairly good smear, about the same as the "B" bar, a mild, commercially available, soap/synthetic bar. Comparable mild bars of this invention, e.g., Examples 1-6 and 8 have improved smears over Example A, as well as the Standard Comparative Example B, which is the "B" bar. Comparative Example C is a leading pure soap bar to show the superior mildness of the bars of this invention over it.

| | Ex. A | Ex. B | Ex. C |
|---|---|---|---|
| Smear 1 | | | |
| Wet (grams)* | 3.20 | 3.66 | — |
| Dry (grams) | 1.50 | 1.43 | — |
| Average | 2.35 | 2.55 | — |
| Smear 2 | | | |
| 5 ml.** | 7.5 | 7.0 | 7.0 |
| pH | 7.3 | 7.3 | 9.5 |
| Soap/FFA ratio | 0.4:1 | 0.5:1 | 1:0 |

*Lower numbers the better.
**Higher numbers the better.

Summary of AGS Surfactant Chain Lengths Used in Examples

| | % Chain Length Distribution | | | | % $C_{16-18}$ |
|---|---|---|---|---|---|
| Example | $C_{12}$ | $C_{14}$ | $C_{16}$ | $C_{18}$ | Chain Length |
| 1-8 | 68 | 25 | 7 | — | 7 |
| A* | 58 | 21 | 10 | 9 | 19 |

*Comparative Example A

The average smears for Examples 1-6 are better than Comparative Example A, notwithstanding the higher AGS alkyl chain distribution, more $C_{16}$ and 9% $C_{18}$ on an AGS weight basis.

| Mildness Test Results Flex Test* | |
|---|---|
| | Erythema |
| Ex. C | 2.42 |
| Ex. 4 | 1.18 |
| Ex. 3 | 0.90 |
| Ex. 7 | 0.68 |
| Ex. B | 0.65-1.29 |
| Ex. 8 | 1.59 Previous Test |
| Ex. A | 1.09 Previous Test |

In the above Flex Test Erythema Results, the lower the erythema, the milder the personal cleanser. Comparative bar Example C, a leading all soap bar, has the highest erythema grade of 2.42. Examples 4, 3, and 7 have erythema grades comparable to the "B" bar which show grades of from about 0.65 to about 1.29, the low and the high of four "B" bar grades. The erythema grades for 4, 3, and 7 are, respectively, 1.18; 0.90; and 0.68. The erythema grades for Example 8 and Comparative Example A are better than the all soap bar, Example C, and are close to the "B" bar.

The "B" bar results 0.65-1.29 are the low and high of four side-by-side Flex Tests for Examples C, 4, 3, and 7. The Flex Test results for Examples 8 and A, while not part of the Example C, 4, 3, and 7 test series, are shown to suggest that Example 8 is not as good as "B," but milder than the all soap bar, Comparative Example C. It is noted that Example 8 has less preferred fatty matter, specifically a lower titer (37) and a higher Iodine Value (38) than Examples 4, 3, and 7. The titers and I.V.'s for Examples 4, 3, 7, and 8 are:

| Example | Titer | Iodine Value |
|---|---|---|
| 4 | 41-44 | Maximum 1.0 |
| 3 | 54.5-55.5 | Maximum 0.5 |
| 7 | 54.5-55.5 | Maximum 0.5 |
| 8 | 37 | 38 |

Referring to Table 1, Example 8, however, has an excellent Smear 2 of 8.

| Forearm Clinical* | | |
|---|---|---|
| | Redness | Dryness |
| Ex. 8 | 1.18 | 1.68 |
| Ex. A | 1.19 | 1.66 |
| Ex. A | 1.16 | 1.70 |
| Ex. B | 1.70 S | 2.22 S |
| Ex. 2 | 1.37 | 1.44 |

-continued

| | Forearm Clinical* | |
|---|---|---|
| | Redness | Dryness |
| Ex. B | 1.69 S | 1.63 S |

*Lower numbers the better.
S = Significance at 90–95% confidence.

Forearm Clinical results suggest that Examples 8, 9, and 2 are all better than "B" for both Redness and Dryness. Examples 8 and A are about equal, and A is significantly better than B. Example 2 is also significantly better than "B."

Example 2 also has superior smears over "B" as shown in Tables 1 and 2; Average Smears 1 are 0.98 for Example 2 vs. 2.55 for "B," which shows a significant advantage for Example 2. Smears 2 are 7.5 for Example 2 vs. 7.0 for "B," which is a slight advantage for Example 2.

A panel of experts compared some sensory characteristics of Example 2 with those of the "B" bar. The results are: Example 2 has sensory characteristics, tightness, smoothness, and softness, comparable to the "B" bar. The tightness result is surprising in view of the presence of 33% magnesium soap in Example 2.

What is claimed is:

1. Process for preparing a mild personal cleansing bar comprising the steps of:

I. preparing a flake composition comprising:

(A) from about 20% to about 50% lathering mild synthetic surfactant and from about 10% to about 50% of magnesium fatty acid soap; wherein the ratio of said lathering mild synthetic surfactant to said soap is from about 5:1 to about 0.4:1; wherein said lathering mild synthetic surfactant consists essentially of $C_{12}$ to $C_{14}$ alkyl chains;

(B) from about 5% to about 40% non-soil-load diluent synthetic surfactant wherein said non-soil-load diluent synthetic surfactant consists essentially of $C_{16}$ to $C_{22}$ alkyl chains; and (C) from about 5% to about 20% of a wax;

wherein said fatty acid soap is made from fatty acid having a titer of 40–75 and an Iodine Value of from zero to 15; and wherein said bar contains no more than about 1.4% of residual sodium soap; and II. forming said bar by plodding said flake composition and stamping cut plugs of said plodded composition into said personal cleansing bars.

2. The process of claim 1 wherein said mild personal cleansing bar comprises: from about 20% to about 50% lathering mild synthetic surfactant and from about 10% to about 50% of magnesium soap; wherein the ratio of said lathering mild synthetic surfactant to said soap is from about 5:1 to about 0.4:1; said bar having a pH of from about 6.5 to about 8.5 in a 1% aqueous solution at 25° C.; and wherein said lathering mild synthetic surfactant consists essentially of $C_{12}$ to $C_{14}$ alkyl chains and said bar contains no more than about 1.4% of residual sodium soap.

3. The process of claim 2 wherein in said mild personal cleansing bar of claim 2 said magnesium soap is from about 10% to about 45%; said ratio is from about 5:1 to about 0.5:1; said bar having a water level of from about 2% to about 15%; and said pH is from about 7 to 8.

4. The process of claim 3 wherein in said mild personal cleansing bar of claim 3 said lathering mild synthetic surfactant to said Mg soap ratio is from about 4:1 to about 0.6:1 and said water level is from about 4% to about 10%.

5. The process of claim 2 wherein in said mild personal cleansing bar of claim 2 said bar contains from about 1% to about 10% free fatty acid and said magnesium soap and said free fatty acid have a ratio of from about 50:1 to about 0.5:1 and wherein said soap and fatty acid has a titer of from 15 to 80 and an Iodine Value of from zero to about 50.

6. The process of claim 5 wherein in said mild personal cleansing bar of claim 5 said bar contains from about 2% to about 8% free fatty acid and said magnesium soap and said free fatty acid have a ratio of from about 15:1 to about 2:1 and said Iodine Value is from zero to about 15 and said titer is from about 40 to about 75.

7. The process of claim 2 wherein in said mild personal cleansing bar of claim 2 said magnesium soap is made by ion exchange.

8. The process of claim 2 wherein in said mild personal cleansing bar of claim 2 said magnesium soap is made by neutralization.

9. The process of claim 2 wherein in said mild personal cleansing bar of claim 2 said bar contains electrolyte at a level of from about 1% to about 10%.

10. The process of claim 9 wherein in said mild personal cleansing bar of claim 9 said level of electrolyte is from about 2% to about 5%.

11. The process of claim 2 wherein in said mild personal cleansing bar of claim 2 said bar contains from 1% to about 40% of hydrophobic material selected from the group consisting of waxes; and other hydrophobic material including free fatty acids containing from about 8 to about 18 carbon atoms; mono-, di-, and triglycerides; fatty alcohols containing from about 8 to about 18 carbon atoms; and mixtures thereof; wherein said composition contains about 25% maximum of said waxes and about 15% maximum of said other hydrophobic material.

12. The process of claim 11 wherein in said mild personal cleansing bar of claim 11 said bar contains a non-soil-load diluent synthetic surfactant at a level of from 5% to 40%; and wherein said non-soil-load diluent synthetic surfactant consists essentially of $C_{16}$ to $C_{18}$ alkyl chains.

13. The process of claim 12 wherein in said mild personal cleansing bar of claim 12 said non-soil-load diluent synthetic surfactant contains at least 90% saturated $C_{16}$ to $C_{18}$ alkyl chains.

14. The process of claim 13 wherein in said mild personal cleansing bar of claim 13 said diluent synthetic surfactant level is from 10% to 35%.

15. The process of claim 1 wherein said mild personal cleansing bar comprises: from about 20% to about 50% lathering mild synthetic surfactant and from about 5% to about 50% of magnesium soap; wherein the ratio of said lathering mild synthetic surfactant to said soap is from about 10:1 to about 0.4:1; from about 1% to about 10% electrolyte; and from about 2% to about 15% water; said bar having a pH of from about 6.5 to about 8.5 in a 1% aqueous solution at 25° C.; and wherein said lathering mild surfactant is selected from $C_{12}$–$C_{14}$ alkyl glyceryl ether sulfonate and $C_{12}$–$C_{14}$ sarcosinate and mixtures thereof.

16. The process of claim 15 wherein in said mild personal cleansing bar of claim 15 said sarcosinate is present at a level of from about 2% to about 25% on a bar weight basis and said pH is from about 7 to about 8.

17. The process of claim 15 wherein in said mild personal cleansing bar of claim 15 said bar contains from 1% to about 40% of hydrophobic material selected from the group consisting of waxes; and other hydrophobic material including free fatty acids containing from about 8 to about 18 carbon atoms; mono-, di-, and triglycerides; fatty alcohols containing from about 8 to about 18 carbon atoms; and mixtures thereof; wherein said composition contains about 25% maximum of said waxes and about 15% maximum of said other hydrophobic material; and wherein said sarcosinate is present at a level of from about 3% to about 20%.

18. The process of claim 17 wherein in said mild personal cleansing bar of claim 17 said level of wax is from about 5% to about 20%.

19. The process of claim 17 wherein in said mild personal cleansing bar of claim 17 said bar contains a non-soil-load diluent synthetic surfactant at a level of from 5% to 40%.

20. The process of claim 19 wherein in said mild personal cleansing bar of claim 19 said non-soil-load diluent synthetic surfactant contains at least 90% saturated $C_{16}$ to $C_{18}$ alkyl chains.

21. The process of claim 20 wherein in said mild personal cleansing bar of claim 20 said diluent synthetic surfactant level is from 15% to 20%.

22. The process of claim 19 wherein in said mild personal cleansing bar of claim 19 said lathering mild surfactant level is from about 25% to about 45% and said non-soil-load synthetic surfactant is from about 15% to about 20%; and said magnesium soap is from about 10% to about 40%.

* * * * *